US009896314B2

(12) United States Patent
Zelinsky

(10) Patent No.: US 9,896,314 B2
(45) Date of Patent: Feb. 20, 2018

(54) REMOTELY ACTIVATED PULLER FOR A TIRE DEFLATION DEVICE

(71) Applicant: Marc Zelinsky, Goose Creek, SC (US)

(72) Inventor: Marc Zelinsky, Goose Creek, SC (US)

( * ) Notice: Subject to any disclaimer, the term of this patent is extended or adjusted under 35 U.S.C. 154(b) by 0 days.

(21) Appl. No.: 15/220,599

(22) Filed: Jul. 27, 2016

(65) Prior Publication Data

US 2017/0183204 A1 Jun. 29, 2017

Related U.S. Application Data

(60) Provisional application No. 62/272,340, filed on Dec. 29, 2015.

(51) Int. Cl.

| | |
|---|---|
| ***B66D 1/12*** | (2006.01) |
| ***B66D 1/60*** | (2006.01) |
| ***B66D 1/46*** | (2006.01) |
| *E01F 13/12* | (2006.01) |

(52) U.S. Cl.

CPC ..... *B66D 1/60* (2013.01); *B66D 1/12* (2013.01); *B66D 1/46* (2013.01); *E01F 13/12* (2013.01)

(58) Field of Classification Search

CPC ... B66D 1/12; B66D 1/14; B66D 1/18; B66D 1/36; B66D 3/006; B66D 3/20; B66D 3/26; B66D 2700/0125; B66D 2700/0141; B66D 2700/0183; B66D 2700/0191; B66D 2700/025

See application file for complete search history.

(56) References Cited

U.S. PATENT DOCUMENTS

| | | | | |
|---|---|---|---|---|
| 3,315,914 A * | 4/1967 | Turner | B61B 12/10 | 242/390.1 |
| 3,456,920 A * | 7/1969 | Elvington | E01F 13/12 | 256/1 |
| 3,645,503 A * | 2/1972 | Doerfling | B66D 1/36 | 242/157.1 |
| 4,123,040 A * | 10/1978 | Kuzarov | B66D 1/28 | 254/342 |
| 4,158,797 A * | 6/1979 | Alcott | H02P 3/16 | 254/342 |
| 4,884,784 A * | 12/1989 | Nix | B66D 1/28 | 254/345 |
| 5,238,200 A * | 8/1993 | Ritzenthaler | A63H 27/002 | 114/254 |
| 5,522,582 A * | 6/1996 | Dilks | B66D 1/00 | 242/587.2 |

(Continued)

OTHER PUBLICATIONS

DynaSpike Remote Control Spike System. (n.d.). Retrieved Nov. 13, 2017, from https://www.dynaspike.com/.

*Primary Examiner* — Emmanuel M Marcelo

(74) *Attorney, Agent, or Firm* — Dunlap Bennett & Ludwig PLLC

(57) ABSTRACT

A remote tire deflation puller is provided. The tire deflation puller includes a housing. At least one battery is disposed within the housing. A motor is disposed within the housing and is powered by the battery. A rope spool is disposed within the housing and is rotatable by the motor. A first end of a rope is attached to the rope spool and runs from the rope spool through an aperture formed in the housing. The motor rotates the rope spool so that the rope wraps around the rope spool. A connector is secured to a second end of the rope, which connects to a spike strip.

10 Claims, 4 Drawing Sheets

(56) References Cited

U.S. PATENT DOCUMENTS

| | | | | | |
|---|---|---|---|---|---|
| 5,803,437 | A * | 9/1998 | Paterson | B66D 1/14 | 254/276 |
| 6,241,215 | B1 * | 6/2001 | Gersemsky | A61G 7/1015 | 254/342 |
| 6,474,903 | B1 * | 11/2002 | Marts | E01F 13/123 | 404/6 |
| 8,132,980 | B1 * | 3/2012 | Lee | E01F 13/12 | 180/287 |
| 9,241,496 | B2 * | 1/2016 | Thickey | A22B 5/00 | |
| 9,315,364 | B2 * | 4/2016 | Averill | B66D 1/12 | |
| 2006/0273293 | A1 * | 12/2006 | Ball | A62B 99/00 | 254/371 |
| 2008/0023681 | A1 * | 1/2008 | Cunningham | B66D 3/20 | 254/362 |
| 2008/0224110 | A1 * | 9/2008 | Starks | B66D 3/20 | 254/264 |
| 2008/0246011 | A1 * | 10/2008 | Heravi | B66D 1/14 | 254/266 |
| 2009/0263191 | A1 * | 10/2009 | Moormeier | E01F 13/12 | 404/6 |
| 2012/0319065 | A1 * | 12/2012 | Scott | B66D 1/12 | 254/362 |
| 2013/0230378 | A1 * | 9/2013 | Fisher | B66D 3/22 | 414/800 |
| 2014/0084229 | A1 * | 3/2014 | Morrison | B66D 1/00 | 254/344 |
| 2014/0264210 | A1 * | 9/2014 | Heravi | B66D 3/20 | 254/344 |
| 2014/0264211 | A1 * | 9/2014 | Yoder | B66D 3/20 | 254/344 |
| 2015/0329335 | A1 * | 11/2015 | Azzarelli | B66D 1/12 | 254/323 |

* cited by examiner

FIG.2
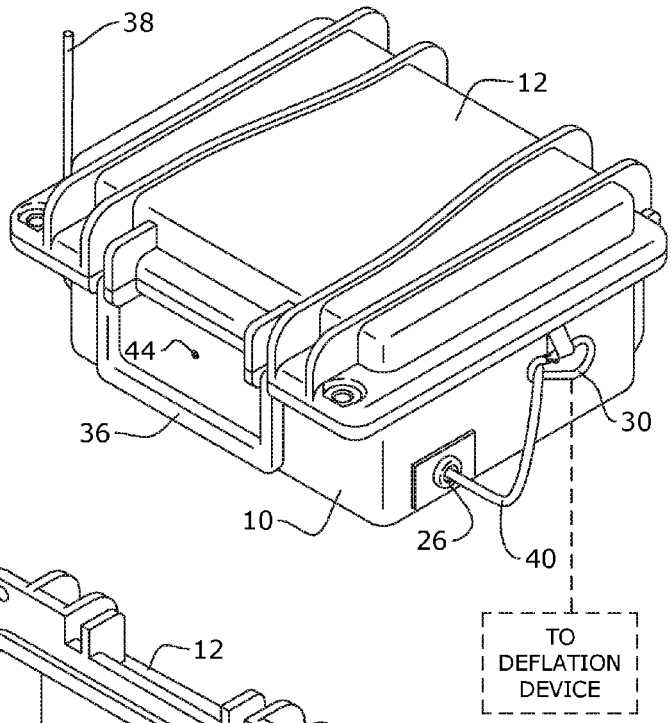
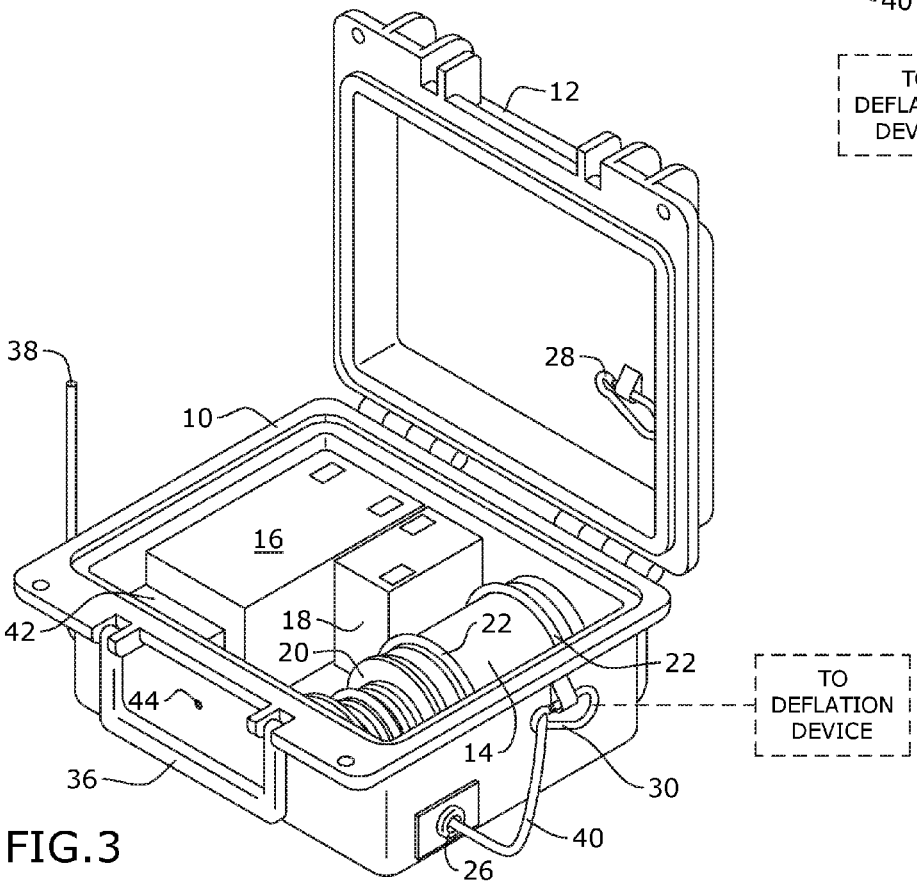
FIG.3

FIG.6
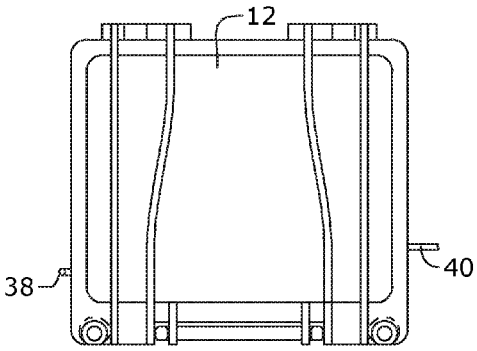
FIG.7
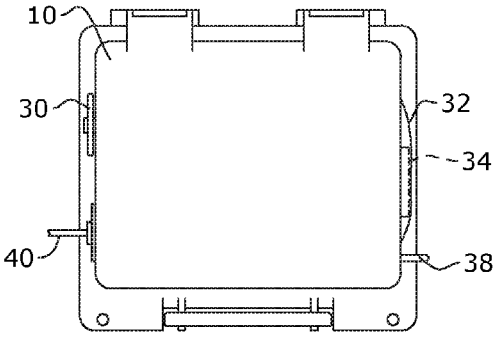
FIG.8
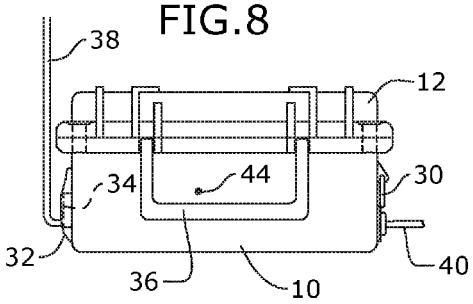
FIG.9
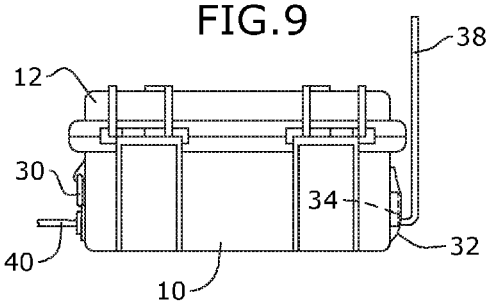
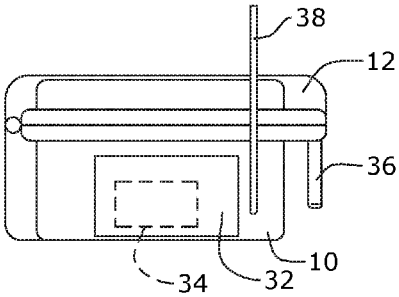
FIG.10
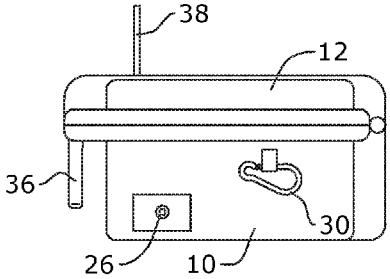
FIG.11

REMOTELY ACTIVATED PULLER FOR A TIRE DEFLATION DEVICE

CROSS-REFERENCE TO RELATED APPLICATION

This application claims the benefit of priority of U.S. provisional application No. 62/272,340, filed Dec. 29, 2015, the contents of which are herein incorporated by reference.

BACKGROUND OF THE INVENTION

The present invention relates to a remotely activated puller for a tire deflation device Law enforcement officers place themselves in harm's way when they attempt to terminate a pursuit by deploying a tire deflation device. Officers drag the tire deflation device into the roadway by hand while standing directly in the path of the fleeing suspect. Since the introduction of tire deflation devices multiple officers have been hurt or killed deploying the devices. The deployment methods coupled with the general knowledge of how law enforcement officers use tire deflation devices has contributed to the dangers.

As can be seen, there is a need for a remotely activated puller for a tire deflation device.

SUMMARY OF THE INVENTION

In one aspect of the present invention, a tire deflation puller comprises: a housing; a battery disposed within the housing; a motor disposed within the housing and powered by the battery; a rope spool disposed within the housing and rotatable by the motor; a rope comprising a first end secured to the rope spool and running from the rope spool through an aperture formed in the housing; and a connector secured to a second end of the rope operable to connect to a spike strip.

In another aspect of the present invention, a tire deflation puller comprises: a housing; a battery disposed within the housing; a motor disposed within the housing and powered by the battery; a rope spool disposed within the housing and rotatable by the motor; a rope comprising a first end secured to the rope spool and running from the rope spool through an aperture formed in the housing; and a wireless receiver and a wireless remote, wherein the wireless receiver is disposed within the housing and is operatively connected to the motor, wherein the wireless remote is operable to communicate with the wireless receiver to turn the motor on and off.

These and other features, aspects and advantages of the present invention will become better understood with reference to the following drawings, description and claims.

BRIEF DESCRIPTION OF THE DRAWINGS

FIG. 2 is a right perspective view of an embodiment of the present invention shown with the lid closed;

FIG. 3 is a right perspective view of an embodiment of the present invention with the lid opened;

FIG. 6 is a top view of an embodiment of the present invention;

FIG. 7 is a bottom view of an embodiment of the present invention;

FIG. 8 is a front view of an embodiment of the present invention;

FIG. 9 is a back view of an embodiment of the present invention;

FIG. 10 is a left view of an embodiment of the present invention; and

FIG. 11 is a right view of an embodiment of the present invention.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

The present invention includes a remotely activated puller for tire deflation devices. The Remotely Activated Puller (TRAP) removes law enforcement officers from the zone of danger when deploying a tire deflation device. The TRAP is placed adjacent to the roadway, and then after the law enforcement officer is in a safe, tactical position the TRAP is activated by wireless remote, which then pulls the tire deflation device into the path of the intended vehicle. The TRAP continues to pull the tire deflation device from the roadway to clear the path for the pursuing law enforcement officers.

The present invention is portable, and can be reset in minutes without any replacement parts. The present invention works with tire deflation devices that most law enforcement agencies already have on hand. The present invention has the advantage of covering multiple lanes of travel in a short period of time and deploys a tire deflation device in a very clandestine way. Finally, the present invention removes the tire deflation device from the roadway quickly avoiding contact with any unintended targets.

The present invention pulls multiple sections of a tire deflation device into the roadway quickly and clandestinely, which increases the probability of contacting the fleeing vehicle. Additionally, the present invention removes the tire deflation device rapidly from the roadway so unintended vehicles will not be impacted. The present invention does not require any replacement parts to reset for subsequent use and it can be reset in a matter of minutes if the tire deflation device needs redeployed.

Figure 1:
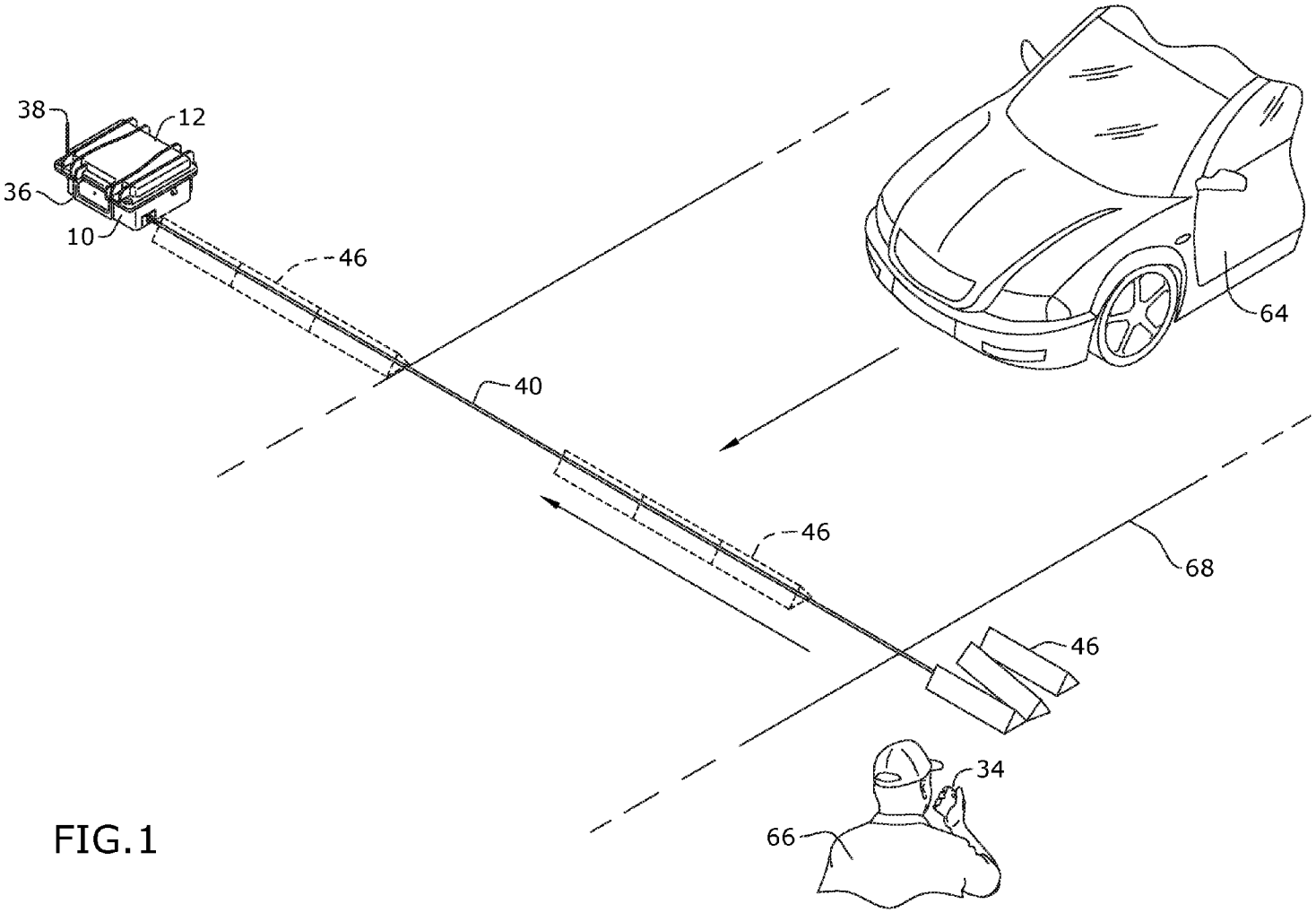
FIG. 1 is a perspective view of an embodiment of the present invention shown in use.
Figure 4:
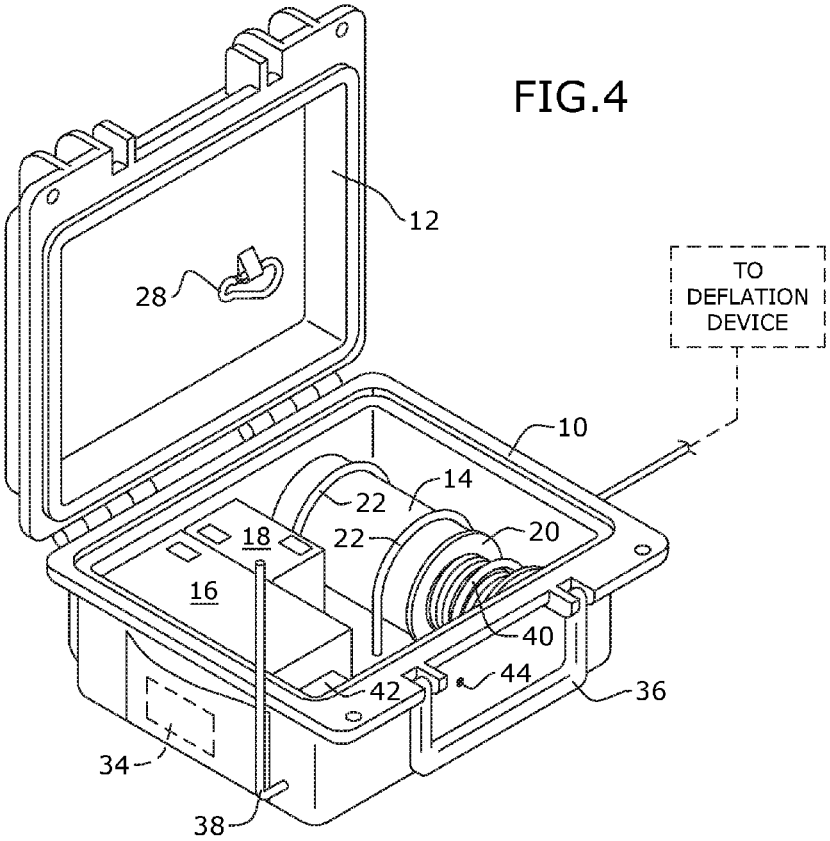
FIG. 4 is a left perspective view of an embodiment of the present invention with the lid opened.
Figure 5:
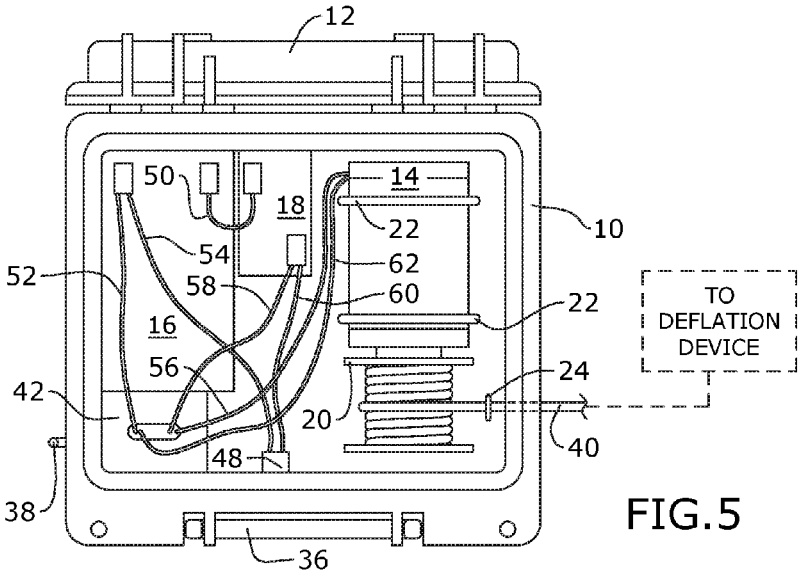
FIG. 5 is a top view of an embodiment of the present invention with the lid opened.

Referring now to FIGS. 1 through 11, the present invention includes a remote tire deflation puller. The tire deflation puller includes a housing 10. At least one battery 16, 18 is disposed within the housing 10. A motor 14 is disposed within the housing 10 and is powered by the battery 16, 18. A rope spool 20 is disposed within the housing and is rotatable by the motor 14. A first end of a rope 40 is attached to the rope spool 20 and runs from the rope spool 20 through an aperture 26 formed in the housing 10. The motor 14 rotates the rope spool 20 so that the rope 40 wraps around the rope spool 20. A connector 28, 30 is secured to a second end of the rope 30, which connects to a spike strip 46.

The housing 10 of the present invention may weigh enough to be able to pull the spike strip 46 towards it without moving. In certain embodiments, the housing 10 may be made of a heavy metal or a heavy metal may be disposed within the housing 10. The housing 10 may further include a lid 12 to open and close the housing 10 to gain access to the internal portion. The lid 12 may be hinged connected to a rim of the housing 10 and operable to open and close an entrance to the housing 10. The housing 10 may further include a handle36 secured to an outer surface.

In certain embodiments, the present invention includes a wireless receiver 42. The wireless receiver 42 is disposed within the housing 10 and is operatively connected to the motor 14. An antenna 38 may be attached to the wireless receiver 42 and extend outside of the housing 10 to add additional range. A remote control 32 is operable to communicate with the wireless receiver 42 and thereby turn on and off the motor 14 from a remote location. In certain embodiments, a pocket 34 may be attached to an outer surface of the housing 10. The pocket 34 is sized to receive and retain the remote control 32 when not in use.

When the motor 14 is turned on, the rope 40 wraps around the rope spool 20 and pulls the spikes 46 onto the road 68 so that the officer 66 may disable the car 64. A rope guide 24, such as a U-shaped rope guide may be secured within the housing 10 adjacent to the aperture 26 to prevent the rope 40 from tangling. As mentioned above, a connector 28, 30 is attached to the second end of the rope 40. The connector 28, 30 may be a first carabineer that is attachable to the spikes strip 46. A back up carabineer 30 may be stored within the housing 10 if the first carbineer 28 breaks.

The motor 14 may be bolted within the housing 10 by a pair of U-shaped brackets 22. The batteries 16, 18 may also be bolted within the housing 10. The batteries 16, 18 may include a 12v battery 16 and a 6v battery 18. A power jack connection 48 having a power jack socket 44 may be used to recharge the batteries 16, 18. A plurality of electrical wires may be used to electrically connect the internal components. A first wire 50 may connect the 12v battery 16 to the 6v battery 18, a second wire 52 may connect the 12v battery 16 to the wireless receiver 42, a third wire 54 may connect the 12v battery 16 to the to the power jack connection 48, a fourth wire 56 connects the wireless receiver 42 to the motor 14, a fifth wire 58 connects the 6v battery 18 with the wireless receiver 42, a sixth wire 60 connects the 6v battery 18 to the power jack connection 48, and a seventh wire 62 connects the remote receiver 42 to the motor 14.

An exemplary embodiment of the present invention may include the following. The plastic protective case has a 5"×2-¼" pocket made from the black knit heavy stretch elastic mounted on the left side of the box using 10 of the black rivets. One piece of loop 2-½" is glued to the elastic pocket and one piece of hook is attached to the case using two rivets. On the right side of the protective case one piece of Hook 1"Length on top of a 3-½" Length of Loop fastened by 2 rivets. On the right side of the case there is a ¾" hole with one nylon spacer inserted and glued in place. One Static-dissipative polyethylene rectangle bar 2" Length, 2-½" Wide is fastened to the outside of the case over the nylon spacer using 4 rivets. One plastic rounded plug with seal is hot glued inside the nylon spacer. On the front of the case by the handle there is one DC female power jack panel mount connector attached where the AC/DC power supply with the 2.1 mm connector is plugged into. Heat shrink tubing 1" length covers the wire connections on the DC power jack. One barrier plate, ABS plastic rectangle bar, 3/64"Thick, 2-½"Wide, 4" Length, is attached to the inside, lower middle of the case using 3 rivets. The 24V brushed DC motor is attached to the steel plate using two U-bolts with nuts through four ⅜" holes drilled into the steel plate. One 3-½" piece of neoprene foam cushions the bottom of the motor against the steel plate. There are a total of eight 1-½" pieces of the neoprene foam, two per side that cushion the U-bolts against the motor. Also attached to the steel plate is one U-bolt using 4 zinc yellow-chromatic hex nuts through two holes drilled into the steel plate.

The steel plate is mounted inside the case using four zinc-plated steel ribbed neck carriage bolts and four zinc steel yellow-chromate plated lock nuts with nylon inserts and four stainless steel split-lock washers through four 5/16" holes drilled into the steel plate. The threads of the carriage bolts are on the inside of the case. One zinc-plated steel square neck carriage bolt is also used to mount the steel plate to the case with one hex nut threads on the inside of the case and one split-lock washer. Two pieces of neoprene foam 4" in length are used under the steel plate. One shaft collar is mounted inside one round, clear impact resistant polycarbonate tube 1-¾" Length. On each end of the round tube 2 plastic PVC discs are glued in place. One 6V sealed lead acid rechargeable battery and one 12V sealed lead acid rechargeable battery are wired in series using one black copper wire 4" Length and two blue quick disconnect female terminals, 22-18 AWG. The wire connections to the batteries are hot glued in place. The motor is wired to the wireless remote relay control using one 2 pin SAE quick disconnect bullet lead connector and two Butt Splice, Vinyl Insulated, blue, 16-14 AWG. The DC power jack is wired to the remote relay control using one 2 pin SAE quick disconnect bullet lead connectors and two insulated barrel quick-disconnect terminals, female, yellow 12-10 AWG, and then connected to the 12v rechargeable battery and 6v rechargeable battery. One flex tubing ¼" center split, 5-½" Length covers the wires from the DC power jack. All wire connections to the batteries are hot glued in place. Two pieces of neoprene foam 3" are hot glued to the top of the 12V battery and two pieces of neoprene foam Length are hot glued.

One Antenna Wire, Stranded 20 AWG 13"Length is attached to the internal antenna wire of the wireless remote relay control kit. The antenna wire is threaded through a black plastic Antenna tube, 10"Length. One black Antenna Cap is glued to the end of the antenna tube. A 2"Length by 2"Width piece of Poly urethane-coated Nylon fabric, 0.022"Thick, is attached over the antenna tube with six black rivets, three on each side. One Black Clip-on EMI RFI Noise Ferrite Core Filter 9 mm is attached around the wire leads coming from the motor and one ferrite core filter is attached to the wires coming from the wireless relay.

The case holds the electric motor, two batteries 12 volt and 6 volt, and the remote control. The rope is wound around the spool that is attached to the shaft of the electric motor. The rope that is threaded from the spool under the U-bolt, which is attached to the steel plate, is pulled from outside of the case by the snap link. The rope is paid out to the desired distance up to 250 feet. The remote control is retrieved from its location in the elastic pocket on the outside of the case. The on button of the remote control is depressed, which activates the remote control relay contained inside of the case. The relay transfers 18 volts from the 12 volt and 6 volt batteries, which are wired in series, to the electric motor. The electric motor operates as intended and rotates the motor shaft counter clock-wise winding the rope back onto the spool. The off button of the remote control can be depressed at any time to stop the motor from operating. The rope can be reset using the wire with hook attached to the inside of the lid in the event that the rope breaks. The second snap link attached by the cable clip to the inside of the lid can be retrieved in the event the other snap link is damaged or lost.

The batteries are charged by plugging in the AC or DC power supply to the power jack located adjacent to the case handle.

The operator of the invention would retrieve the case from the stored location after quickly unplugging the power supply battery charger. The invention along with the applicable tire deflation device would be carried by the operator to the designated deployment location and placed on the ground. The operator would retrieve the remote control from its stored location, and then retrieve the snap link that is attached to the outside of the invention. The operator would attach the snap link to the tire deflation device. Then, the operator would carry the tire deflation device across the intended target area, which would pay out the rope from the spool holding the rope inside the invention. The weight of the invention components ensures that the invention maintains its deployed location. Once the desired location is reached the operator drops the tire deflation device in no particular configuration. The operator then moves to a safe location within the effective range of the remote control, which is at least 75 ft up to 100 ft. At the desired time the operator depresses the on button of the remote control, which activates the remote supplying power to the electric motor and the rope is retracted onto the spool. As the rope is retracted onto the spool the tire deflation device is pulled into the roadway and into the path of the intended target. The operator may depress the off button of the remote to stop the electric motor at any time; thereby stopping the tire deflation devices from traversing the target roadway area. If the operator stops the electric motor and the tire deflation devices are left in the roadway the operator can again depress the remote control on button to activate the electric motor inside the invention to remove the tire deflation device from the roadway. Once the invention is used as intended the operator can retrieve it along with the tire deflation devices from the side of the roadway and reset if necessary to reuse in a subsequent location. If the invention is not reused it is returned to the desired storage location and the power supply charger is plugged in to keep the batteries charged until the next deployment of the invention.

It should be understood, of course, that the foregoing relates to exemplary embodiments of the invention and that modifications may be made without departing from the spirit and scope of the invention as set forth in the following claims.

What is claimed is:

1. A tire deflation puller comprising:

a housing;

a battery disposed within the housing;

a motor disposed within the housing and powered by the battery;

a rope spool disposed within the housing and rotatable by the motor;

a rope comprising a first end secured to the rope spool and running from the rope spool through an aperture formed in the housing;

a connector secured to a second end of the rope; and a spike strip secured to the rope by the connecter, wherein the tire deflation puller comprises a deployed position and a retracted position, the deployed position comprising the rope unwound from the rope spool and substantially outside of the housing, the retracted position comprising the rope wound on the rope spool and substantially inside the housing, wherein the spike strip is outside of the housing in the deployed position and the retracted position.

2. The tire deflation puller of claim 1, further comprises a wireless receiver and a wireless remote, wherein the wireless receiver is disposed within the housing and is operatively connected to the motor, wherein the wireless remote is operable to communicate with the wireless receiver to turn the motor on and off.

3. The tire deflation puller of claim 2, further comprising an antenna attached to the wireless receiver and extending outside of the housing.

4. The tire deflation puller of claim 2, further comprising a pocket attached to the housing and sized to receive the wireless remote within.

5. The tire deflation puller of claim 4, wherein the pocket is attached to an outer surface of the housing.

6. The tire deflation puller of claim 1, further comprising a lid hinged connected to a rim of the housing and operable to open and close an entrance to the housing.

7. The tire deflation puller of claim 1, further comprising a U shaped rope guide secured within the housing adjacent to the aperture.

8. The tire deflation puller of claim 1, further comprising a metal plate disposed within the housing.

9. A tire deflation puller comprising:

a housing;

a battery disposed within the housing;

a motor disposed within the housing and powered by the battery;

a rope spool disposed within the housing and rotatable by the motor;

a rope comprising a first end secured to the rope spool and running from the rope spool through an aperture formed in the housing;

a wireless receiver and a wireless remote, wherein the wireless receiver is disposed within the housing and is operatively connected to the motor, wherein the wireless remote is operable to communicate with the wireless receiver to turn the motor on and off; and a spike strip secured to a second end of the rope, wherein the tire deflation puller comprises a deployed position and a retracted position, the deployed position comprising the rope unwound from the rope spool and substantially outside of the housing, the retracted position comprising the rope wound on the rope spool and substantially inside the housing, wherein the spike strip is outside of the housing in the deployed position and the retracted position.

10. The tire deflation puller of claim 1, further comprising a connector secured to a second end of the rope and connected to the spike strip.

* * * * *